US011623786B2

(12) United States Patent
Olson et al.

(10) Patent No.: US 11,623,786 B2
(45) Date of Patent: Apr. 11, 2023

(54) APPARATUS FOR CONSTRUCTION OF A STRINGER OF A CORRUGATE PALLET

(71) Applicant: THE GARDNER GROUP, LLC, Springfield, MO (US)

(72) Inventors: Randal D. Olson, Lakeland, MN (US); Joel R. Olson, Menomonie, WI (US)

( * ) Notice: Subject to any disclaimer, the term of this patent is extended or adjusted under 35 U.S.C. 154(b) by 0 days.

(21) Appl. No.: 17/225,016

(22) Filed: Apr. 7, 2021

(65) Prior Publication Data

US 2021/0221558 A1 Jul. 22, 2021

Related U.S. Application Data

(63) Continuation of application No. 16/946,617, filed on Jun. 29, 2020, now abandoned, which is a continuation of application No. 16/615,349, filed as application No. PCT/US2019/035842 on Jun. 6, 2019, now Pat. No. 10,723,508.

(60) Provisional application No. 62/682,230, filed on Jun. 8, 2018.

(51) Int. Cl.
*B65D 19/00* (2006.01)
*B31D 3/00* (2017.01)

(52) U.S. Cl.
CPC ..... *B65D 19/0012* (2013.01); *B31D 3/005* (2013.01); *B65D 2519/00019* (2013.01); *B65D 2519/00034* (2013.01); *B65D 2519/00054* (2013.01); *B65D 2519/00069* (2013.01); *B65D 2519/00089* (2013.01); *B65D 2519/00104* (2013.01); *B65D 2519/00273* (2013.01); *B65D 2519/00293* (2013.01); *B65D 2519/00323* (2013.01); *B65D 2519/00333* (2013.01); *B65D 2519/00562* (2013.01)

(58) Field of Classification Search
CPC ..... B65D 19/0012; B65D 2519/00019; B65D 2519/00034; B65D 2519/00054; B65D 2519/00069; B65D 2519/00089; B65D 2519/00104; B65D 2519/00273; B65D 2519/00293; B65D 2519/00323; B65D 2519/00333; B65D 2519/00562; B65D 2519/00288; B65D 2519/00318; B65D 2519/00343; B65D 2519/00378; B31D 3/005
See application file for complete search history.

(56) References Cited

U.S. PATENT DOCUMENTS 4,067,615 A 1/1978 Gehry
5,207,631 A 5/1993 Schmidtke et al.
5,255,841 A * 10/1993 Ritter ..... B65D 5/247 229/179

(Continued)

OTHER PUBLICATIONS

ISA/US, International Search Report and Written Opinion for PCT/US2019/035842, dated Aug. 15, 2019, 9 pgs.

*Primary Examiner* — Hanh V Tran
(74) *Attorney, Agent, or Firm* — Cardle Patent Law Chtd

(57) ABSTRACT

An apparatus for construction of a stringer of a pallet is disclosed herein. In various aspects, the apparatus includes a corrugate sheet (30) cut to form a stringer shape sheet (32) with the stringer shape sheet (32) having a plurality of parallel stringer sections (33) defined by cuts from an upper surface through a lower surface of the stringer shape sheet (32). Each stringer section (33) on the stringer shape sheet (32) may be linked to an adjacent stringer section (33) by a plurality of shear bridges (34).

10 Claims, 7 Drawing Sheets

(56) References Cited

U.S. PATENT DOCUMENTS

| | | | | |
|---|---|---|---|---|
| 5,366,790 | A | 11/1994 | Liebel | |
| 5,425,314 | A | 6/1995 | MacFarland | |
| 5,427,019 | A | 6/1995 | Moorman | |
| 5,433,156 | A | 7/1995 | Hutchison | |
| 5,461,988 | A | 10/1995 | Cummings et al. | |
| 5,568,774 | A | 10/1996 | Hutchison | |
| 5,609,557 | A | 3/1997 | Te | |
| 5,660,404 | A | 8/1997 | Dilley | |
| 5,685,234 | A | 11/1997 | Grigsby et al. | |
| 5,704,487 | A | 1/1998 | Taravella et al. | |
| 5,996,509 | A | 12/1999 | Lai | |
| 6,155,181 | A | 12/2000 | Chilcutt | |
| 6,354,229 | B1 | 3/2002 | Heidtke | |
| 6,357,364 | B1 | 3/2002 | Maloney et al. | |
| 6,453,827 | B1 | 9/2002 | Perazzo | |
| 6,739,270 | B1 | 5/2004 | Sewell | |
| 2002/0069955 | A1 | 6/2002 | Wang | |
| 2002/0166481 | A1 | 11/2002 | Perazzo | |
| 2002/0189507 | A1 | 12/2002 | Benner | |
| 2004/0045486 | A1 | 3/2004 | Pistner et al. | |
| 2004/0137196 | A1 | 7/2004 | Wang | |
| 2005/0029141 | A1 | 2/2005 | Cornelius et al. | |
| 2005/0241549 | A1 | 11/2005 | Gordon | |
| 2005/0247240 | A1* | 11/2005 | Nelson ..... | B65D 19/0012 108/51.3 |
| 2007/0187285 | A1 | 8/2007 | Stokes | |
| 2011/0132238 | A1 | 6/2011 | Jaegers et al. | |
| 2012/0325719 | A1 | 12/2012 | Jian | |
| 2014/0130720 | A1 | 5/2014 | Nelson | |
| 2014/0251188 | A1 | 9/2014 | Jordan | |
| 2015/0122160 | A1 | 5/2015 | Frautschi et al. | |
| 2017/0283141 | A1 | 10/2017 | Lee | |

* cited by examiner

APPARATUS FOR CONSTRUCTION OF A STRINGER OF A CORRUGATE PALLET

CROSS-REFERENCE TO RELATED APPLICATIONS

This application is a continuation of U.S. patent application Ser. No. 16/946,617 filed 29 Jun. 2020, which is a continuation of U.S. patent application Ser. No. 16/615,349 filed 20 Nov. 2019 (now U.S. Pat. No. 10,723,508 issued on 28 Jul. 2020), which is a 371 National Stage Application of PCT Application No. PCT/US2019/035842 filed 6 Jun. 2019, which claims priority of U.S. Provisional Patent Application No. 62/682,230 filed 8 Jun. 2018 and are all hereby incorporated by reference in their entireties herein.

BACKGROUND OF THE INVENTION

Field of the Invention

This disclosure relates to shipping pallets, and, more particularly, to shipping pallets fabricated, at least in part, from corrugate.

Background of the Related Art

Pallets and skids, collectively herein pallets, in various forms have been an important part of shipping freight since the 1930's. Historically, pallets were constructed of wood. Wooden shipping pallets are relatively costly, heavy and susceptible to damage. Wood continues to dominate the pallet market today. In recent history, lighter plastic pallets and more durable metal pallets have been developed. However, both of these options tend to be costly.

The conditions under which most pallets are used typically results in damage that can render the pallet unusable after a short amount of time. Plastic pallets, when damaged, are typically not repairable. Wood pallets are regularly repaired, but this results in a huge amount of waste wood that is relatively difficult to dispose of. Metal pallets tend to resist damage better but their price point and weight is too high to be usable in typical shipping applications. Industries are almost always looking for ways to save costs. Accordingly, a need exists for lower cost, lightweight pallets. As a result, the past few decades have seen shipping pallets developed from other materials. One such material is corrugated fiberboard. Corrugated fiberboard, in certain aspects, may include a fluted corrugated sheet in combination with one or two flat linerboards formed of paper based material(s) that may include cellulose derived from wood including other plant based materials. In certain aspects, the corrugate sheet may include corrugated plastic, or other materials, and combinations of materials, as would be readily recognized by those of ordinary skill in the art upon study of this disclosure. Corrugated fiberboard is a strong renewable material that is one of the most widely recycled materials in the world. Corrugated fiberboard generally has a high tensile strength but its strength under compression is most significant when applied along the longitudinal axis of the flutes. The flutes of the corrugated fiberboard provide a columnar structure along their longitudinal axis that is strong in compression, in certain aspects. Accordingly, it may be advantageous to configure certain components of corrugate pallets with the flutes of the corrugated fiberboard oriented vertically.

To maximize strength and durability, corrugate pallet manufacturers have used manufacturing techniques which cut and laminated corrugated fiberboard with the flutes oriented in the desired orientation and cut the material to form the desired components. The cutting blades typically remove a swath of material equivalent to a width of the cutting blades as the cutting blades cut the laminated corrugated fiberboard into the desired component for the pallet. Use of cutting blades can create a tremendous amount of paper dust that is both a hazard to workers and a disposal problem for the manufacturers. Accordingly, a need exists for efficient methodologies to form corrugate pallets without generating significant amounts of dust.

One solution has been to score or crease corrugate sheets to permit the corrugated fiberboard to be folded into the desired components. However, the folding process complicates and slows the manufacturing process as both sides of the corrugated fiberboard sheets require the application of an adhesive to hold the component in its finished and folded configuration and the folding process of a single corrugated fiberboard sheet is relatively slow and mechanically complex. Further, the integrity of the bond adjacent to the fold may also be compromised, as there is a tendency for the linerboard to separate at the fold and to fail to properly bond. Also, both the creasing and the folding of corrugate sheets can compromise the structure of the flutes in areas adjacent to the score or crease reducing the compressional strength of the resulting laminated corrugate structure. The geometry of a folded corrugated fiberboard sheet can also create alternating high and low ridges on the upper and lower surface of a corrugated stringer that can result in less bonding surface. This reduces the surface area available for the adhesive bonding used in many corrugate pallet designs that can weaken the resulting stringer and its adhesive bond with other pallet elements. Alternatively, fully precutting each corrugated fiberboard sheet into plurality of separate individual corrugate pieces and laminating the individual cut corrugate pieces into the individual components can address these problems but is highly inefficient and cost prohibitive.

Therefore, a need exists for efficient manufacturing of corrugate components for pallets from corrugated fiberboard that does not compromise the strength or durability of the components and is also cost effective.

BRIEF SUMMARY OF THE INVENTION

Apparatus and methods in accordance with the present inventions may resolve many of the needs and shortcomings discussed above and may provide additional improvements and advantages that may be recognized by those of ordinary skill in the art upon study of the present disclosure.

Apparatus in accordance with various aspects of the present inventions may be configured as shipping pallets. The shipping pallets may include an upper deck and two or more stringers. The upper deck may include one or more deck boards. In certain configurations, the shipping pallets may also include a lower deck. The upper deck and lower decks may be adhesively bonded to the stringers, may be secured by mechanical fasteners or by notched engagements between the stringers and/or deck boards.

Methods in accordance with aspects of the present inventions may be utilized to form shipping pallets. The methods are for manufacturing stringers for pallets from sheets of corrugate. The methods allow for the simultaneous build-up of a plurality of corrugate stringers while laminating corrugate sheets. The method includes providing a plurality of corrugate sheets sized and/or arranged to be die cut into stringers. The corrugate sheets are each die cut to form a plurality of stringer shape sheets. Each stringer shape sheet has a plurality of stringers defined by cuts from an upper surface of the corrugate sheets through the lower surface of the corrugate sheets. Each stringer on each stringer shape sheet is linked to the adjacent stringer by a plurality of shear bridges. The shear bridges are links of uncut corrugate material between the adjacent stringers. Once die cut, the stringer shape sheets are aligned over one another to superimpose the shape of the plurality of stringers on the adjacent stringer shape sheets. The adjacent sheets are typically bonded to one another with an adhesive to form laminated corrugate stringer blocks. The adhesive may be placed on one or more of the abutting surfaces in the laminate. The bonding step may include the coating at least one of an upper surface and a lower surface of the stringer shape sheets with an adhesive. Once formed, the laminated corrugate stringer block includes a plurality of stringers linked by a plurality of shear bridges. The stringers are released by severing, typically by tearing or cutting, the plurality of shear bridges to release one or more of the stringers from the corrugate block. The severing of the plurality of shear bridges may include applying a force to at least one of the plurality of stringers to break each of the plurality of shear bridges between the stringer and the corrugated stringer block to release a stringer from the laminated corrugate stringer block. The method can further include aligning of the plurality of stringer shape sheets to superimpose the shear bridges on the adjacent corrugate sheets. In this aspect, the shear bridges are die cut in each stringer shape sheet such that, when the stringers are superimposed over one another, each of the shear bridges is superimposed over the shear bridges on the other stringer shape sheet layers in the laminated corrugate stringer block.

Other features and advantages of the invention will become apparent from the following detailed description, and from the Claims. This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1:
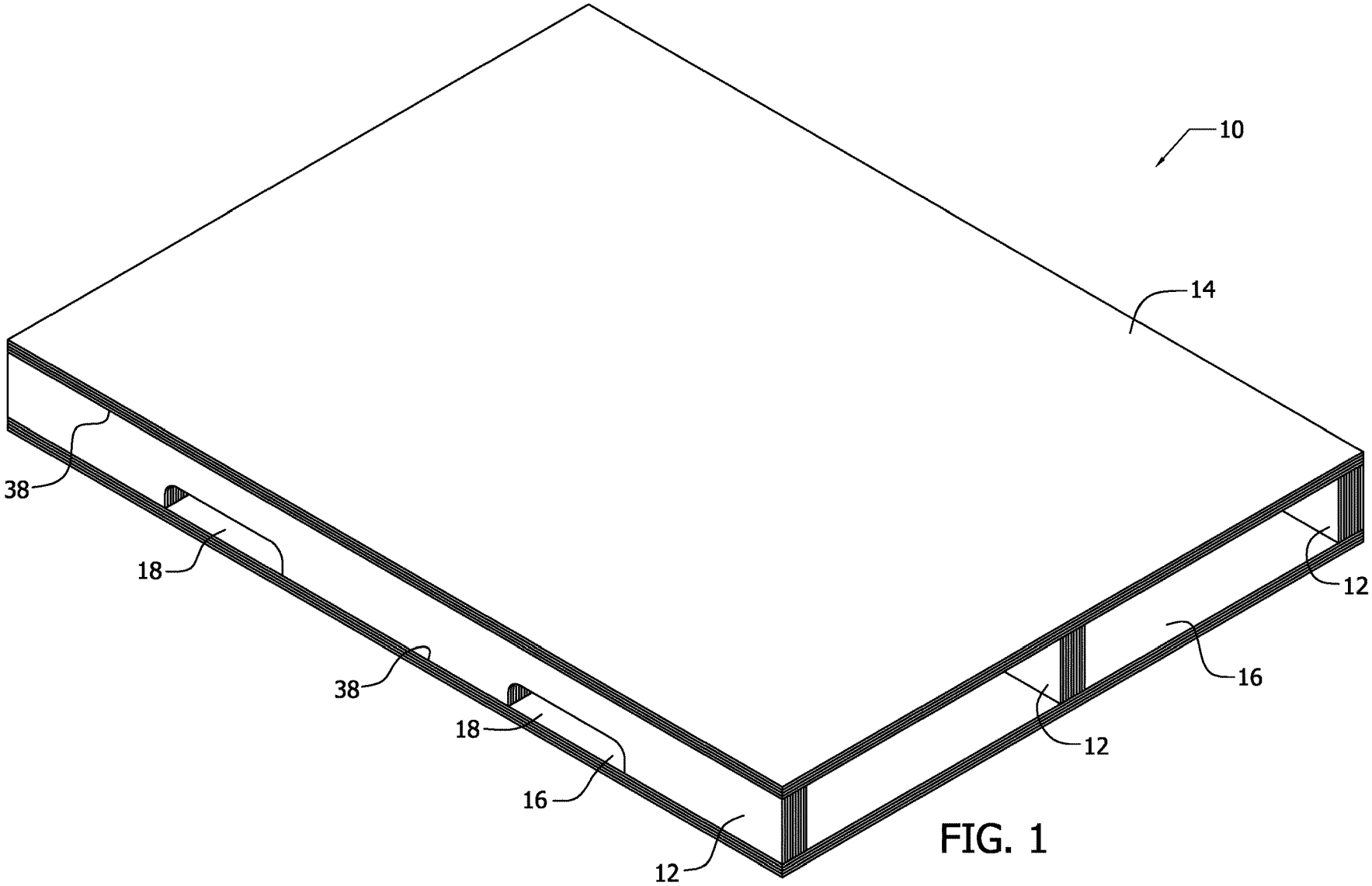
FIG. 1 illustrates a perspective view of an exemplary shipping pallet in accordance with aspects of the present inventions.

All Figures are exemplary and selected for explanation of the basic teachings of the present inventions only. Extensions of the Figures with respect to number, position, relationship and dimensions of the parts to form the preferred implementation will be explained or will be within the skill of the art after the following description has been read and understood. Further, the exact dimensions and dimensional proportions to conform to specific force, weight, strength, and similar requirements for various implementations will likewise be within the skill of the art after the following description has been read and understood.

Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

The Figures generally illustrate exemplary implementations of a shipping pallet 10 and the corrugate stringers 12 used in shipping pallets 10 that include aspects manufactured in accordance with the present inventions. The particularly illustrated implementations of the stringers 12 have been chosen for ease of explanation and understanding of various aspects of the present inventions. It will be understood that the term shipping pallet shall include other similar products used for shipping cargo such as skids, shipping crates, shipping spacers and the like that may use the corrugate stringers 12 or other structurally similar components manufactured in accordance with methods of the present teachings. That said, the illustrated implementations are not meant to limit the scope of coverage but, instead, to assist in understanding the context of the language used in this specification and in the appended claims. Accordingly, the appended claims may encompass variations of stringers 12 and similar pallet and packing components that differ from the illustrated implementations.

The present inventions provide methods for the manufacture of shipping pallet 10 and components thereof for use in shipping and storage applications. The shipping pallets 10 are predominately manufactured from corrugated fiberboard or corrugated plastic, both of which are referred to collectively hereinafter as corrugate. As noted below, these sheets when laminated can include alternative materials in certain layers of the laminate. An exemplary shipping pallet 10 is illustrated in FIG. 1. Shipping pallet 10 may be generally configured to support a load that may consist of various items individually, boxed or otherwise packaged. Shipping pallet 10 may be configured to be lifted by forklift and, in various implementations, may be configured to be placed, for example, in a storage rack, cargo hold, storage bay, railroad car, or truck trailer. Shipping pallet 10 may be configured as either a 2-way or as a 4-way pallet. Shipping pallet 10, as illustrated, includes an upper deck 14 and one or more stringers 12 secured to the upper deck 14, and shipping pallet 10 is configured to receive and support a load on the upper deck 14. The stringers 12 support the upper deck 14. Upper deck 14 may be single solid piece of corrugate, laminated corrugate, or may include two or more deck boards, in various implementations. For example, the upper deck 14 may include between 4 and 6 individual deck boards secured to the upper surface of the stringers 12, but upper deck 14 may include more deck boards in certain implementations. Upper deck 14 may be generally configured to meet certain capacity requirements, to support a specific load, or to support a specific cargo.

Stringers 12 are generally elongated support elements having a generally rectangular side profile, in this implementation. Stringers 12 may have a generally flat upper surface and lower surface, and the upper and lower surfaces of stringer 12 may include shaped cutouts to receive various components of the pallet 10. The stringers 12 may provide notches 18 for the tines of a forklift or for a pallet jack underneath the upper deck 14. Notches 18 are configured to receive the tines of a forklift to enable the lifting pallet 10 including materials placed upon upper deck 14 and extend from one side of the stringer 12 through to the other side, in various implementations. The notches 18 of adjacent stringers 12 of a pallet 10 may be aligned with one another to permit the passage of the tines of a forklift and/or, in certain configurations, a pallet jack through the side of shipping pallet 10 to provide more flexible access and utility in shipping pallet 10.

Lower deck 16 may also be included in pallet 10, in certain implementations. The two or more stringers 12 are generally secured between the upper deck 14 and the lower deck 16, as illustrated. The lower deck 16 may be, for example, a single solid piece of corrugate or multiple pieces of laminated corrugate. In other implementations, the lower deck 16 may be composed of a fiberboard or other material. Lower deck 16 may include 3 or 4 separate boards configured to permit the pallet 10 to be used with a pallet jack that, for example, allows a user to manually raise and move a loaded pallet 10 around a warehouse. In one implementation, the shipping pallet 10 may be manufactured solely or predominantly from recyclable materials, such as, for example, paper, corrugate, fiberboard and other paper products.

Figure 3A:
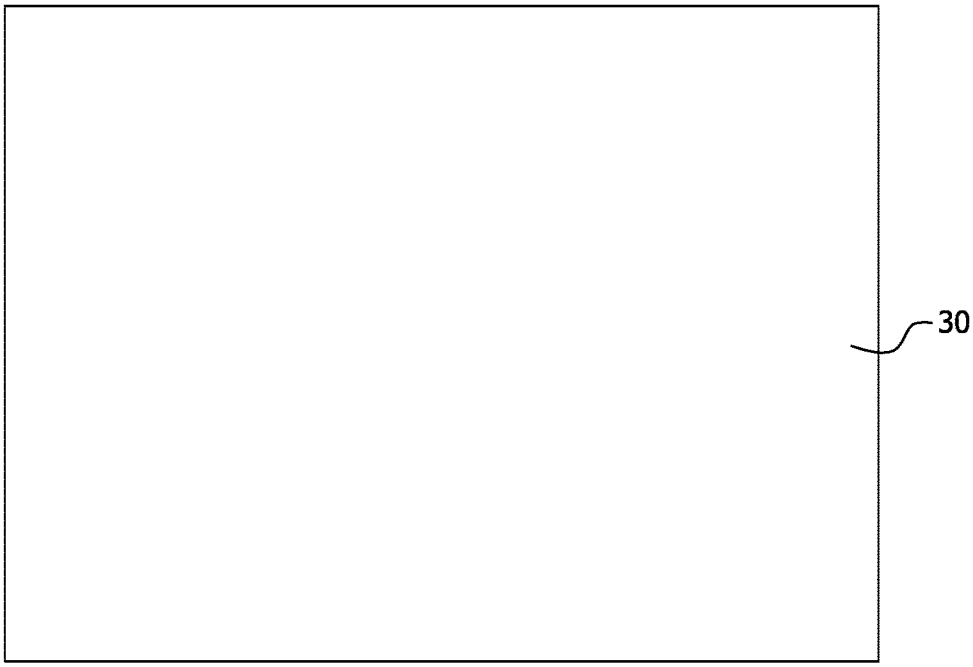
FIG. 3A illustrates a top view of an exemplary corrugate sheet in accordance with aspects of the present inventions.

In accordance with the present inventions, a plurality of stringers 12 are simultaneously formed from corrugate sheets 30 laminated together. An exemplary configuration for a corrugate sheet 30 is illustrated in FIG. 3A. The corrugate sheets 30 used may be, for example, "A", "B", "C", "E", "F" or "microflute" as well as other flute configurations that may be used in the paper industry, as would be readily recognized by those of ordinary skill in the art upon study of this disclosure. Similarly, the corrugate sheets 30 may be single wall, double wall or triple wall as used in the paper industry, as would be readily recognized by those of ordinary skill in the art upon study of this disclosure. It will be appreciated that the fluted medium strength along the load-bearing axis typically increases with flute density. The choice of flute density as well as the materials and choice of adhesive included in the corrugate sheets 30 will depend upon the specific design requirements for the stringer 12 including the loads to be carried. Typically, each layer of the laminate is selected to have a relatively constant thickness, regardless of whether a layer is composed of a single sheet of corrugate or multiple sheets of corrugate. Stringer 12 may include a plurality of corrugated sheets 30 and stringer 12 may include one or more solid fiberboard layers for added strength. The corrugate sheets 30 and, if present, alternative materials are secured together, for example, with an adhesive between the linerboards of the corrugate sheets 30. Specific compositions for the laminate used in stringer 12 may be selected based on the particular design requirements for stringer 12 including, for example, forces to be supported by stringer 12. Similarly, the orientation of the flutes in the corrugate of stringer 12 as well as the geometric configuration of the corrugate may be selected based upon specific design requirements for the stringer 12. In certain implementations, the flutes will be vertically oriented and the flutes of a majority of the layers will be parallel to one another in the vertical orientation.

The stringer 12 may be sized to have a length substantially the same as the desired length of the finished shipping pallet 10. This will frequently correspond to the length of the deck board if the upper deck 14 is formed from a single board. The width of the stringers 12 is generally between about 1.5 inches (3.81 cm) and about 4.0 inches (10.16 cm). Certain design requirements may require that stringer 12 have a greater strength. Stringers 12 may be strengthened by increasing in number of layers of corrugate sheet 30, by changing the material of the corrugate sheet 30, through the elimination of notches 18, and/or by the addition of solid fiberboard sheet or sheets of other strong materials into the laminate.

The stringers 12 are formed from die cutting individual corrugate sheets 30, laminating them into laminated stringer block 40, and separating the individual stingers 12 from the laminated stringer block 40. The process for manufacturing stringers 12 in accordance with the present inventions generally includes die cutting a single corrugate sheet 30 to define one layer of a laminated stringer block 40 that includes a plurality of separate linked stringers 12. When cut, the corrugate sheet 30 is transformed into the stringer shape sheet 32 which includes the cut outs of individual stringer sections 33. The individual stringer sections remain interconnected by shear bridges 34 to hold together as the stringer shape sheet 32. Each stringer section 33 will form a layer of a distinct stringer 12 after lamination. The shear bridges 34 are illustrated in FIGS. 3A to 3E for exemplary purposes. The shear bridges 34 connect each stringer section 33, before lamination, and stringer 12, after lamination, at multiple points to the adjacent stringer section 33 or stringer 12, in various implementations. The shear bridges 34 are generally configured to retain the die cut plurality of stringer sections 33 in position in a corrugate shape sheet 32 as it is processed by individuals and/or machinery during manufacture. This allows multiple stringers 12 to be simultaneously laminated in a laminated stringer block 40. A finished laminated stringer block 40 comprising a plurality of stringers 12 interconnected by the shear bridges 34. The thickness of the laminated stringer block 40 corresponds to the desired width of the resulting stringers 12 after they are removed from the laminated stringer block 40. The thickness will generally correlate with strength when using the same materials.

The corrugate sheets 30 are selected so that the size and strength of the corrugate sheet 30, when laminated, will generate the required strength and, if desired, help minimize the weight of the resulting stringers 12. The corrugate sheets 30 may be new or previously used. In certain implementations, the corrugate sheets 30 may be derived from Old Cardboard Containers (OCC) that may be readily available from recycling companies. OCC may provide an even more environmentally friendly alternative to new corrugate materials. Repurposing the used material, OCC, as opposed to immediately placing the OCC into the recycle chain may save a significant amount of resources that would otherwise be dedicated to the transportation, recycling and redistribution of the recycled corrugate material derived from the OCC. Thus, the use of OCC in the manufacture of stringers 12 generally reduces the environmental footprint of the resulting shipping products. Further, the relatively low cost using OCC as a source for corrugate sheets 30, as opposed to newly manufactured corrugate, may reduce the cost of producing the shipping pallets 10. In one implementation, the efficient integration of multiple corrugate sheets 30 may be used in a single layer of the laminate. This permits the use of corrugate sheets 30 shorter than the overall length of the stringer 12, which increases the variety of OCC sheet sizes that can be utilized with the present process. This can be particularly important because the sizes of sheets of OCC as corrugate sheet 30 may vary in size, which is distinct from manufacturing with new corrugate sheets 30 that are typically provided in the desired length and width. New corrugate sheets 30 may be sized during its original manufacture to a desired width and length to prevent/reduce waste. This can improve the efficiency of manufacturing, as each corrugate sheet 30 may be the same size. However, the reduced cost of OCC as corrugate sheet 30 may offset manufacturing efficiencies when using new corrugate sheets 30. In certain implementations, the present disclosure provides a process where OCC may be efficiently integrated into the manufacturing process of laminated stringer 12 as the source for as corrugate sheets 30. Further, various manufacturing processes disclosed herein may be used to efficiently to allow a single oversized corrugate sheet 30 whether from new corrugate or OCC, to be used in each layer of the laminated stringer block 40. The use of single corrugate sheets 30 may increase the strength by eliminating the breaks 36 generated when using multiple sheets of corrugate in a layer of laminated stringer block 40. In other implementations, new corrugated sheets 30, fiberboard or plastic, may also or alternatively be used for one or more layers of the laminated stringer block 40.

In certain implementations, the corrugate sheets 30 may be cut from their upper surface through to their lower surface to transforms the corrugate sheets 30 into corrugate shape sheets 32 that include multiple cut out stringer sections 33. As a layer of an individual stringer 12 may include multiple stringer sections 33, the stringer sections 33 will have a shape corresponding to only a portion of the side profile of the resulting stringer 12. A second and, in some cases, a third stringer section 33 would complete remainder of the shape of the stringer's 12 side profile in that layer of stringer 12. In stringer sections 33 representing the entire length of the stringer 12, the stringer section 33 will have a shape that corresponds to the entire length of the side profile of the resulting stringer 12. The process of die cutting may utilize rotary die cutting, flatbed die cutting or other may use other variations of die cutting, as would be readily recognized by those of ordinary skill in the art upon study of the present disclosure. Die cutting may reduce, if not eliminate, dust generated when using a saw to cut corrugate sheets 30, a laminated stringer block 40, or an uncut block of laminated corrugate.

The corrugate sheets 30 are die cut to form a stringer shape sheet 32. The stringer shape sheet 32 has the shape of a plurality of stringer sections 33 cut through it. The stringer sections 33 will be superimposed with and bonded to adjacent stringers sections 33 of other stringer shape sheets 32 in the number of layers required or desired for the final application of stringer 12. Each of the plurality of stringer layers 33 on each stringer shape sheet 32 is linked to adjacent stringer sections 33 by a plurality of shear bridges 34. The corrugate sheets 30 may be cut to orient the flutes of the corrugate vertically in the cutout stringer shape such that the flutes will extend from a lower surface to an upper surface of the stringer 12 when the corrugate sheets 30 are laminated. This configuration may maximize the strength of the corrugate laminate in the vertical axis to maximize the ability of a shipping pallet 10 having a stringer 12 to support a load. A single corrugate sheet 30 may be sized in length and width to form the die cut stringers shape sheets 32 without generating any waste cuttings from the ends or sides of the corrugate sheet 30.

Alternatively, the die cutter may be configured to cut oversized corrugate sheets 30 to the proper length and width to form the stringer shape sheets 32. Such oversized corrugate sheets 30 would result in waste trimmings that may be recycled. Similarly, when a single layer of laminate has multiple stringer shape sheets 32 integrated into the layer, the combined length and width of each corrugate sheet 30 used in that layer may be selected or cut such that their combined sized and shape form the stringer shape sheets 32 without generating any waste cuttings from their ends or sides. Again alternatively, the die cutter may be configured to cut multiple oversized corrugate sheets 30 to the proper length and/or width to form a single stringer shape sheet 32. Such oversized sheets would result in waste trimmings that would typically be recycled.

As discussed above, the die cutting of the corrugate sheets 30 cuts the outline of the shape of each stringer 12 through the corrugated sheet 30 as stringer sections 33. This cutting also defines and leaves the plurality of shear bridges 34 between the adjacent stringer sections 33 on each individual stringer shape sheet 32. This also leaves the adjacent stringers 12 connected to one another after lamination and allows for efficient processing during the laminating or "build-up" steps that laminate the adjacent stringer sections 33 into stringers 12. There may be at least 3 or more shear bridges 34 between adjacent stringer sections 33, in various implementations. As illustrated, the shear bridges 34 are uncut links of material left in each corrugate sheet 30 between the adjacent stringers 12. The shear bridges 34 are designed to permit the separation of a substantially finished stringer 12 from adjacent stringers 12 in the laminated stringer block 40 after the adhesive 38 has sufficiently cured. The shear bridges 34 may be broken by the application of a mechanical force to the laminated stringer block 40 thereby releasing the adjacent stringers 12 from one another, in certain implementations.

The shear bridges 34 are generally configured to permit the stringer 12 to be removed from the laminated stringer block 40 by the application of a severing force or cutting to the shear bridges 12, in certain implementations. The configuration of the shear bridges 34 may vary depending upon the nature and qualities of the materials used. The shear bridges 34 may be uncut on either the upper or lower surface of the corrugate sheet 30 or the shear bridges 34 may be uncut on only an upper or lower surface. That is, one of the upper surface or the lower surface may be cut across or partially across the width of the shear bridge 34 while leaving the other surface uncut and intact. Such a configuration could reduce the overall strength of the shear bridge 34 to facilitate a clean tear and could reduce any residual artifact 35 left after the severing of the stringer 12. Shear bridge 34 may have a width between about 0.1 inches (0.25 cm) and about 0.4 inches (1 cm) along the axis of the cut from the die cutter, in various implementations. In implementations where a B or C flute corrugate is used, the width of the shear bridges 34 may be about 0.2 inches (0.50 cm) wide, which may allow for the efficient severing of the stringer 12. Variations in the materials, such as the used of different grades of corrugate, utilizing a plastic corrugate, or integrating one or more fiberboard layers into the laminate, may allow or necessitate the use of a positioning, width and/or number of shear bridges 34, as will be readily recognized by those of ordinary skill in the art upon study of the present disclosure.

The number and positioning of the shear bridges 34 is selected based on the composition of the corrugate sheets 30 and, when used, other materials in the laminate. The particular configuration typically seeks to adequately maintain the link between the stringers 12 during lamination and to retain the stringers 12 on the corrugated stringer block 40 until it is desired to sever the stringers 12 from the corrugated stringer block 40, in various implementations. The number and positioning of the shear bridges 34, in combination with their width may be selected to at least retain the overall shape and integrity of stringer shape sheet 32 as stringer shape sheet 32 is subjected to the various mechanical forces as stringer shape sheet 32 is passed through the manual and/or automated steps in the assembly of laminated corrugate block 40 and to retain the stringers 12 on the laminated stringer block 40 until it is desired in the process to remove the stringer 12 from the laminated stringer block 40. In their general design, the shear bridges 34 must retain the stringers 12 in relative position with respect to one another in the stringer shape sheet 32 as stringer shape sheet 32 is cut, transported to a gluer, as a layer of glue is applied by the gluer, and as the stringer shape sheet 32 is moved toward and positioned relative to other the stringer shape sheets 32 and then laminated into the laminated stringer block 40. Once laminated, shear bridges 34 must hold the stringer shape block 40 together until the manufacturer desires to separate the individual stringers 12 from the stringer block 40.

In certain implementations, the sizing of the shear bridges 34 is minimized for any given application to reduce the force required to break the shear bridges 34 and separate the adjacent stringers 12 and/or minimize residual artifact 35 left by the broken shear bridge 34 on the upper surface of the stringer 12. The size of the residual artifact 35 may be minimized by reducing its size and/or physical profile. Further, the positioning of the shear bridges 34 along the stringers 12 may be selected to minimize any interference of the residual artifact 35 on the upper and lower surfaces of the stringer 12 with the adhesive bonding of the upper and lower deck boards with the stringer 12, respectively, or the other components of the pallet 10. That is in certain implementations, the positioning of the shear bridges 12 may be selected so that the residual artifact 35 is positioned between the deck boards on pallets 10 that include multiple separated deck boards. Where the residual artifacts 35 are positioned in a location to be bonded, the additional manufacturing step of cutting or abrading the residual artifact 35 off of the stringer 12 may be integrated into its manufacture. Again, variations in the materials, such as the used of different grades of corrugate, utilizing a plastic corrugate or integrating one or more fiberboard layers into the laminate, may allow or necessitate the use of an alternative width, positioning and/or number of shear bridges 34 in various implementations.

Figure 2A:
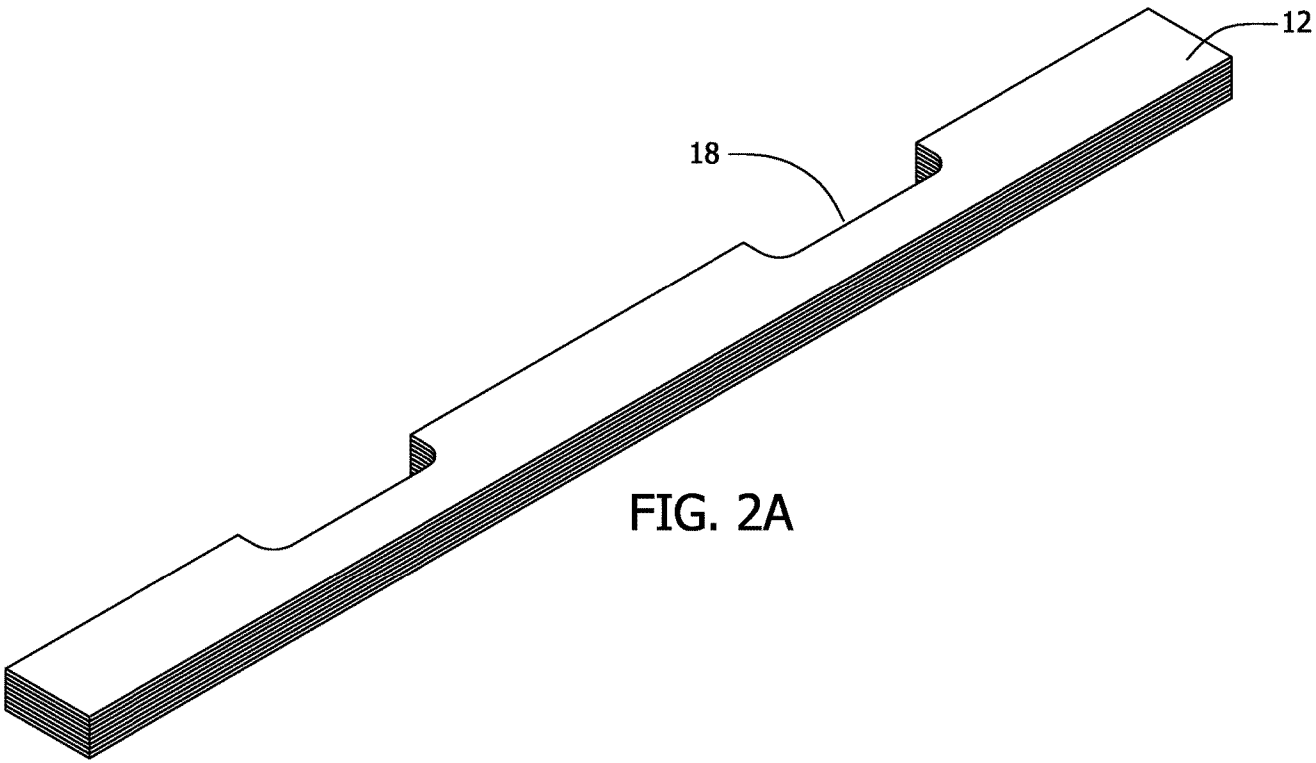
FIG. 2A illustrates a perspective view of an exemplary single stringer in accordance with aspects of the present inventions.
Figure 2B:
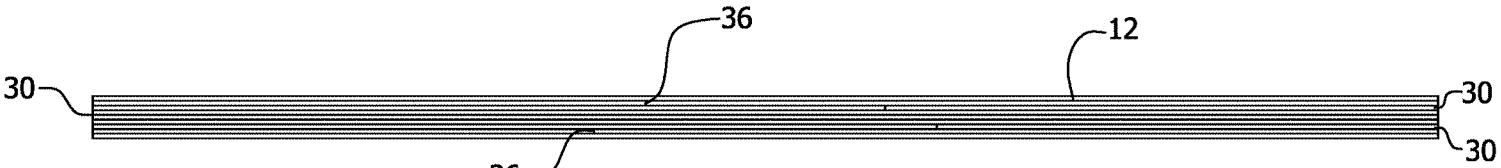
FIG. 2B illustrates a top view of an exemplary stringer for a shipping pallet in accordance with aspects of the present inventions.
Figure 2C:
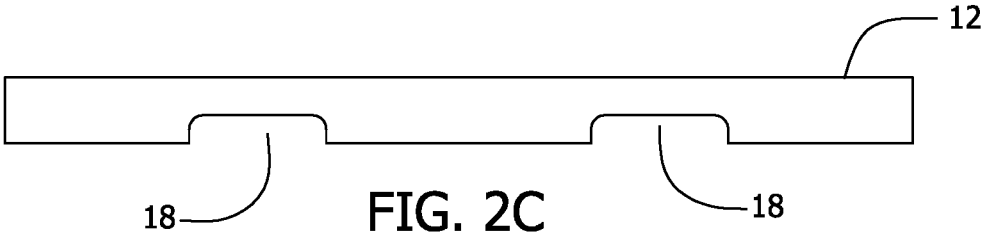
FIG. 2C illustrates a side view of an exemplary stringer for a shipping pallet in accordance with aspects of the present inventions.
Figure 2D:
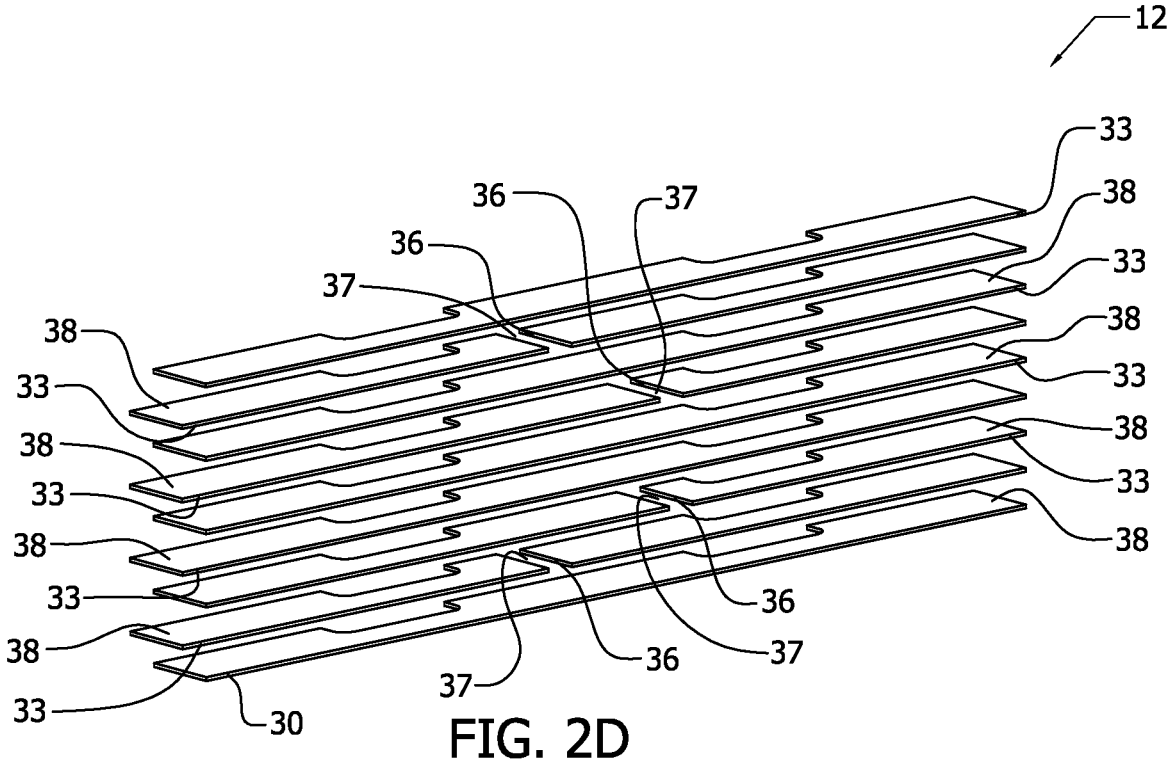
FIG. 2D illustrates an exploded view of an exemplary single stringer in accordance with aspects of the present inventions.

A layer of adhesive 38, illustrated in FIGS. 1, 2D, is typically applied to a surface of the stringer shape sheets 32. The adhesive 38 may be selected in accordance with the materials being glued to have the strength and characteristics necessary for the end use of the stringer 12, as will be readily recognized by those of ordinary skill in the art upon study of the present disclosure. The adhesive 38 may be applied to an upper surface as the stringer shape sheets 32 are processed, typically as stringer shape sheets 32 lay flat on a surface or on a conveyor. With certain manufacturing methodologies, the adhesive 38 may alternatively be placed on a lower surface of the corrugate sheet 30. In various implementations, the adhesive 38 is applied over the entire surface that will form the stringers 12. In certain implementations. A surface of stringer shape sheet 32 may have adhesive 38 applied over a portion of the surface in certain applications and/or for cost savings. Adhesive costs may represent a significant cost in the production of laminated corrugate products and minimizing these costs may be significantly beneficial.

For example, to begin forming the laminate stringer block 40, a second stringer shape sheet 32 is superimposed over a stringer shape sheet 32 aligning the cut stringer sections 33 in each of the two stringer shape sheets 32. The adhesive 38 positioned between the two corrugate sheets 30 is used to bond the two stringer shape sheets 32 together. In some implementations, the shear bridges 34 on adjacent stringer shape sheets 32 are in the same position and the die cut edges are aligned with one another when the stringer sections 33 are superimposed. In other implementations, the shear bridges 34 on each stringer shape sheets 32 may not correspond to the positioning of the shear bridges 34 on the adjacent corrugate sheets 30. Additional stringer shape sheets 32 are aligned over and bonded to the laminated stringer block 40 until the height of the block equal to or slightly higher than the desired width of the stringer 12, in various implementations. With adhesive 38 is of certain adhesive types, the laminated stringer block 40 may be placed under compression to assure optimal contact between the layers of the laminate as the adhesive 38 cures.

Once adhesives 38 have adequately cured or other adequately set, the individual stringers 12 may be removed from the laminated stringer block 40. The stringers 12 are removed by applying a force to sever the shear bridges 34. The force, for example, may be a shear force to break the shear bridges 34 or may be applied by a cutting blade that cuts the shear bridges 34. That is, the severing of shear bridges 34 may be through cutting or tearing in variations of the present inventions. In certain automated, semi-automated and manual systems, this force may be a vertical sheer force applied to the bottom or top of a stringer 12 to be removed while the laminated stringer block 40 is secured in a set position. In certain implementations, the force may be from the impact of a machine component or an impact from the hand of an individual. After removal from the laminated stringer block 40, stringer 12 may be used as is or may be further processed to remove the residual artifact 35 left by the broken shear bridge 34. Once severed, the shear bridges 34 may leave a shear bridge artifact 35 where the shear bridge 34 was severed. In certain methods and configurations, this shear bridge artifact 35 may be left on the resulting stringer 12. In other methods or configurations, this shear bridge artifact 35 may be mechanically removed as discussed above.

Turning now to the Figures, aspects of the present invention may include forming a shipping pallet 10, as shown in FIG. 1, including stringers 12, as shown in more detail in FIGS. 2A, 2B, 2C, 2D and 3E. The shipping pallet 10 of FIG. 1 includes a solid upper deck 14, three stringers 12 and a solid lower deck 16. The stringers 12 include notches 18 that are aligned with one another. The upper deck 14 is shown as a single solid piece of laminated corrugate for exemplary purposes. Similarly, the lower deck 16 is shown as a single solid piece of laminated corrugate for exemplary purposes. The upper deck 14 and the lower deck 16 are illustrated as secured to the stringers 12 with an adhesive 38. The adhesive 38 being positioned between the lower surface of the deck boards and the upper surface of the stringer 12 to secure the upper deck 14 to the stringers 12. The adhesive 38 may also be positioned between the upper surface of the lower deck boards and the lower surface of the stringer 12 to secure the lower deck 16 to the stringers 12.

FIGS. 2A, 2B, 2C, 2D and 3E illustrates the details of an exemplary stringer 12. The stringer 12, as illustrated, was formed by laminating nine layers of stringer shape sheets 32 in the build-up for exemplary purposes. Accordingly, the stringer 12 includes nine laminated stringer sections 33. The nine illustrated layers include the $1^{st}$, $3^{rd}$, $5^{th}$, $7^{th}$, and $9^{th}$ layers which are each formed from a single continuous corrugate sheet 30 cut into a single stringer shape sheet 32. The $2^{nd}$, $4^{th}$, $6^{th}$, and $8^{th}$ layers are each formed from two stringer sections 33 from two separate corrugate sheets 30 cut into a two stringer shape sheets 32 each aligned in a single layer during at least the lamination process. This may leave a break 37 between the adjacent parallel edges 36 of the corrugate sheets 30 positioned proximate to one another. The edges 36 are contiguous or nearly contiguous with one another from the upper surface of the stringer to the lower surface of the stringer 12, in various implementations. Further, the edges 36 and resultant breaks 37 may be configured to be staggered along the length of the stringer 12 to maximize its strength of the stringer 12 such that the breaks 37 do not significantly weaken the structural integrity or may minimize the weakening caused by having the breaks 37. Further in stringers 12 with notches 18, the breaks 37 may be positioned not to be coincident with the notches 18 of stringers 12 along their length as can be seen by comparison of the exemplary breaks 37 in the Figures relative to the notches 18 along the length of stringer 12 to enhance their strength and durability.

Figure 3B:
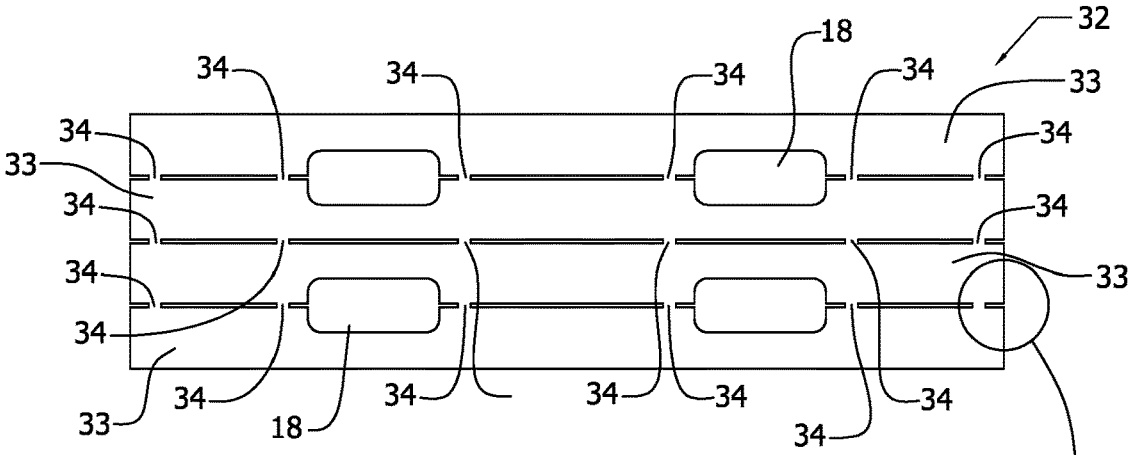
FIG. 3B illustrates a top view of an exemplary corrugate sheet after die cutting in accordance with aspects of the present inventions.
Figure 3C:
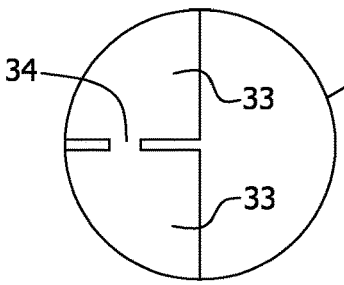
FIG. 3C illustrates a top view of a portion of the die cut corrugate sheet of FIG. 3B showing a shear bridge in accordance with aspects of the present inventions.
Figure 3D:
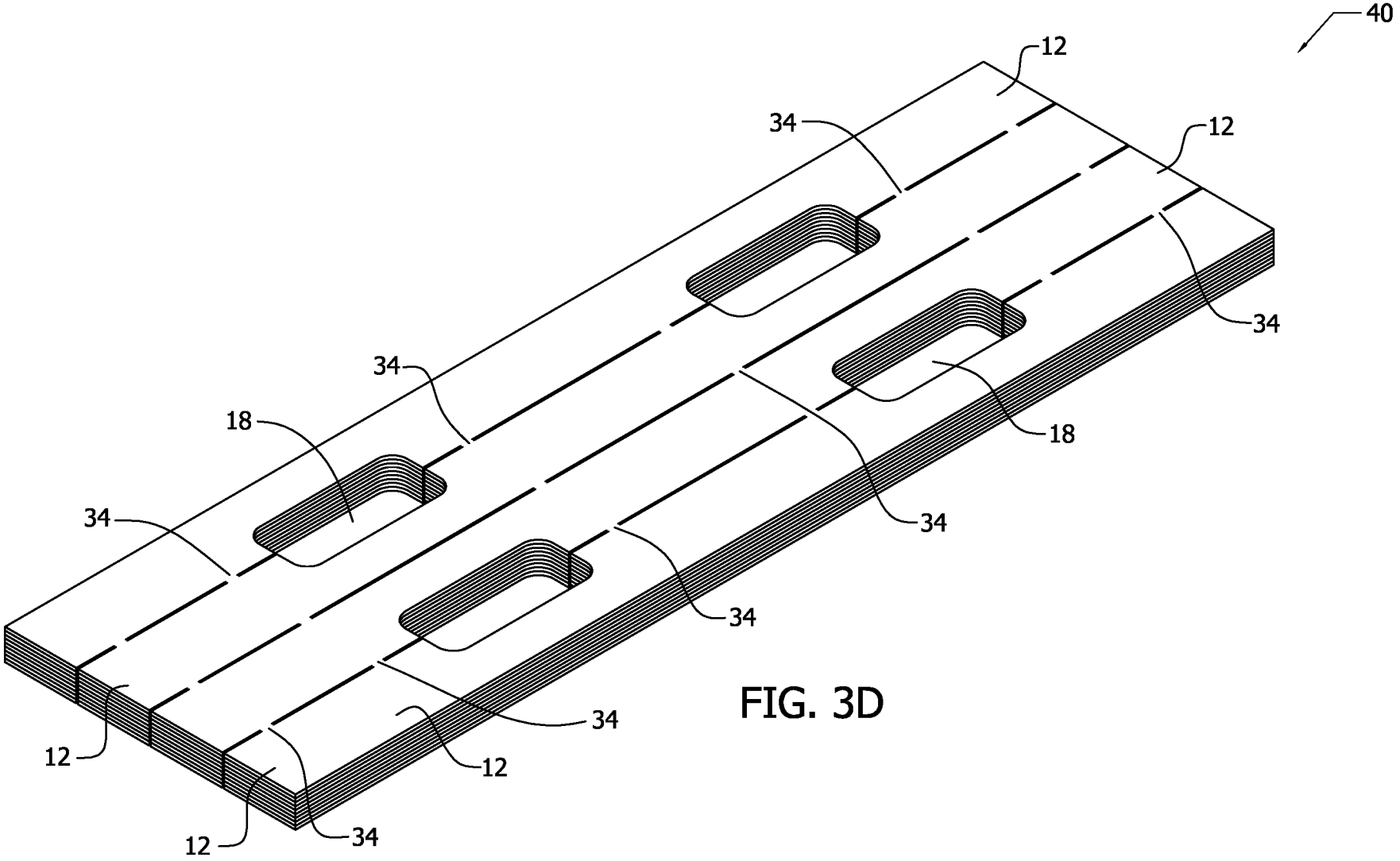
FIG. 3D illustrates a perspective view of an exemplary laminated corrugate stringer block in accordance with aspects of the present inventions.
Figure 3E:
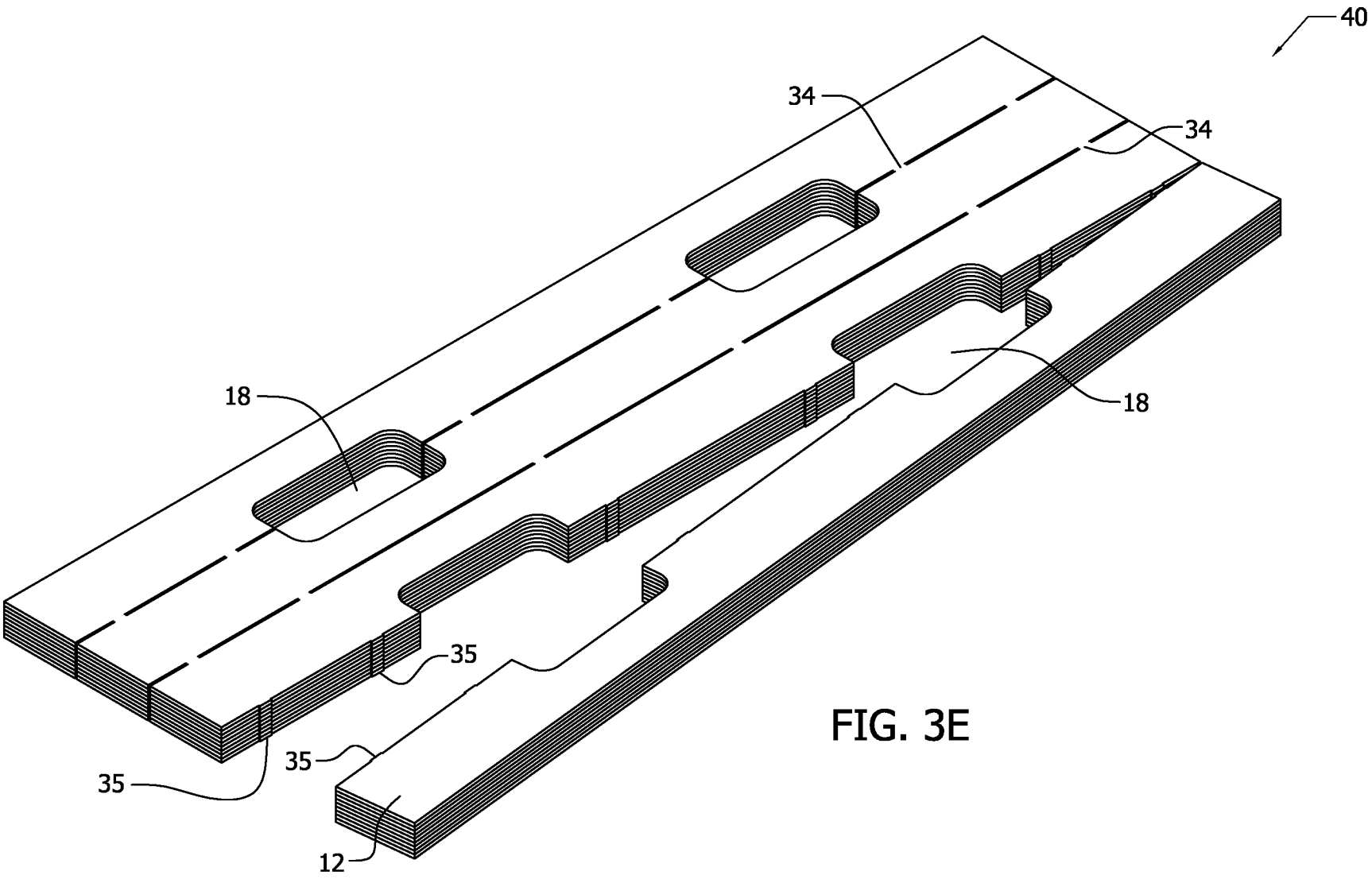
FIG. 3E illustrates a perspective view of an exemplary laminated corrugate stringer block having stringer partially removed in accordance with aspects of the present inventions; and, FIG. 4 illustrates a flow chart of an exemplary manufacturing process in accordance with aspects of the present inventions.
Figure 4:
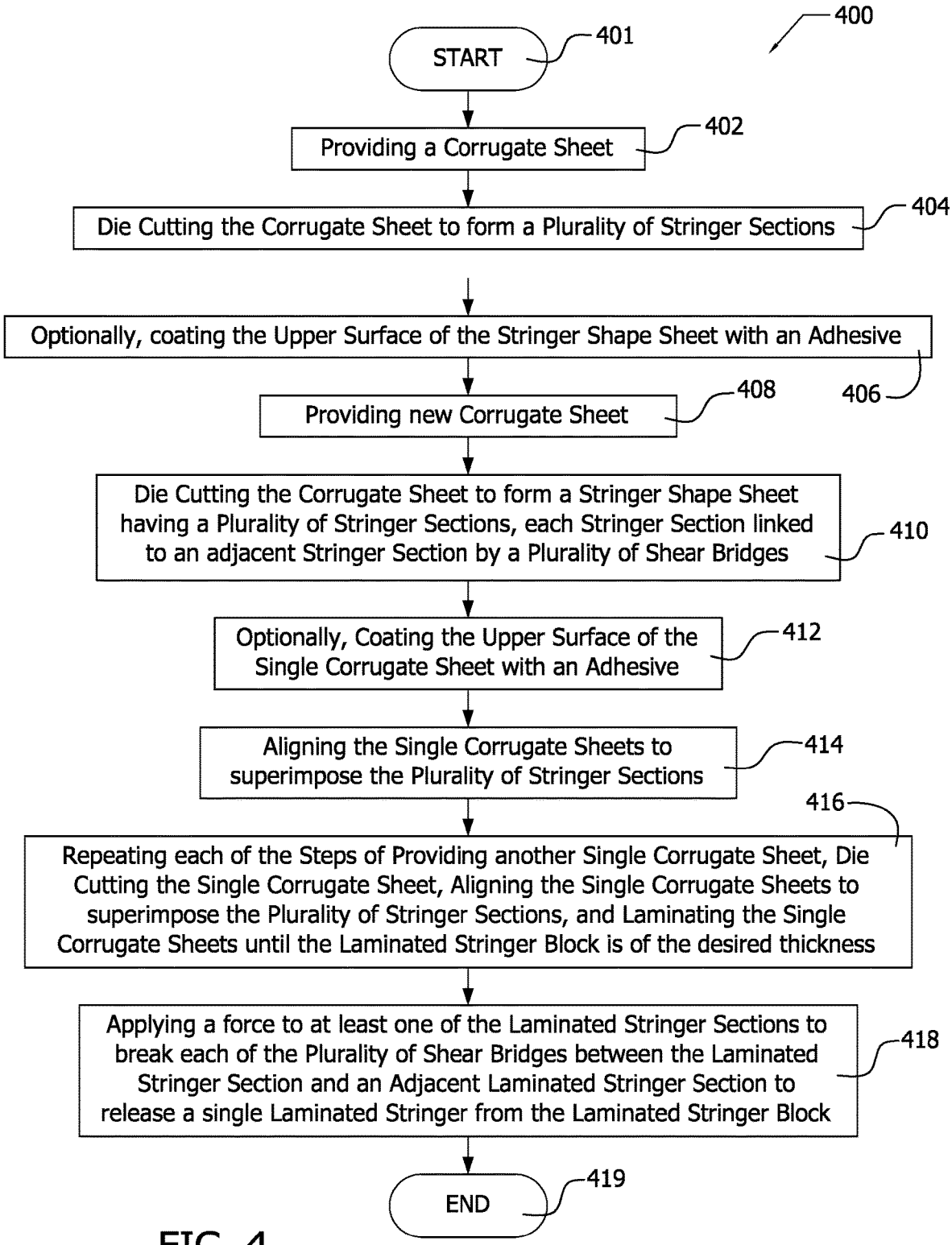

The general steps of exemplary manufacturing method 400 and intermediates structures are illustrated in FIGS. 3A to 3E and in the exemplary process flow diagram of FIG. 4. Method 400 is entered at step 401. As illustrated in FIG. 4, step 402 includes providing a first corrugate sheet 30, as shown in FIG. 3A.

At step 404, the corrugate sheet 30 is die cut to form a stringer shape sheet 32. The stringer shape sheet 32 includes a plurality of stringer sections 33 linked by a plurality of shear bridges 34. For purposes of explanations, the stringer shape sheet 32 cut from the corrugate sheet 30 of FIG. 3B is shown to utilize only about half the corrugate sheet 30 in FIGS. 3A, 3D and 3E. The illustrated stringer shape sheet 32 of FIG. 3B defines four stringer sections 33. Each stringer section 33 on a single stringer shape sheet 32 will form a layer of a separate stringer 12. As particularly illustrated, adjacent stringer sections 33 are linked to one another by six shear bridges 34. As discussed above, the shear bridges 34 are sized, positioned and to maintain the stringers 12 in the correct relative positions to the stringers 12 in the other stringer shapes sheets 32 that are laminated together into a laminated stringer block 40 as illustrated in FIG. 3D.

At step 406, a subsequent corrugate sheet 30 is provided. At step 408, the subsequent corrugate sheet 30 is die cut into a subsequent stringer shape sheet 32 having a plurality of stringer sections 33 linked by a plurality of shear bridges 34. At step 410, the subsequent stringer shape sheet 32 is positioned over and aligned with the first corrugate shape sheet 32 to superimpose the plurality of stringer sections 33 of the stringer shape sheets 32 on top of one another.

At step 412, the first stringer shape sheet 32 and the second stringer shape sheet 32 are bonded to one another while aligned over one another. An adhesive 38 compatible with the materials and having the desired bonding strength is used to bond the stringer shape sheets 32 to one another. In step 412, at least a portion of a surface of one of the stringer shape sheets 32 is coated with an adhesive. The adhesive 38, shown in FIGS. 1 and 2D, is typically placed on an upper surface of the stringer shape sheet 32 to enable it to be mechanically conveyed without depositing adhesive 38 on machinery. When using manual manufacturing or robotic arms the surface of the stringer shape sheet 32 coated with adhesive 38 can vary.

At step 414, the prior steps starting at step 406 are repeated as the laminating or "build-up" process until the thickness of the laminated stringer block 40 reaches the desired thickness for the stringers 12. This completes the formation of the laminated stringer block 40. The laminated stringer block 40 may optionally also be placed under compression until the adhesive 38 has adequately secured the laminated layers of stringer shape sheets 32. This compression can improve the strength of the bonding of the layers. Steps 406, 408, 410, 412, 414 are repeated at step 416 to form the laminated stringer block 40.

At step 418, stringer 12 may be released from the laminated stringer block 40 by applying a force to an upper surface of stringer 12 to break the plurality of shear bridges 34 connecting it to the laminated stringer block 40 as shown in FIG. 3E. Exemplary method 400 terminates at step 419. Although method 400 is discussed as a series of steps, those skilled in the art may recognize variations of method 400 including, for example, the order of the steps or multiple steps that can be combined into a single step without departing from the scope of the present invention.

Further, as will be recognized by those skilled in the art upon review of the present disclosure, stringers 12 and other components of shipping pallet 10 may be further modified to have desired properties. For example, the stringer 12 or other components may be wrapped with a paper or plastic or may be treated, at least in part, with, inter alia, fire retardants, insecticides, pesticides, fungicides, and waterproofing to inhibit deterioration. Other materials such as metal foils, plastics, resin impregnated paper, and other fibrous materials such as fibrous glass materials may also be incorporated into various implementations of shipping pallet 10.

In operation, the shipping pallet 10 may be used to transport and store materials in the same manner as a standard wooden, plastic, or metal pallet. Shipping pallet 10 may be constructed, at least in part, using stringers 12. When the useful life of shipping pallet 10 is completed, the shipping pallet 10 may be disposed of, at least in part, by recycling. Other devices that would be recognized by those skilled in the art upon review of the present disclosure may be fabricated, at least in part, from stringers 12 according to the present inventions.

The foregoing discussion along with the Figures discloses and describes various exemplary implementations. These implementations are not meant to limit the scope of coverage, but, instead, to assist in understanding the context of the language used in this specification and in the claims. The Abstract is presented, for example, to meet requirements of 37 C.F.R. § 1.72(b) only. This Abstract is not intended to identify key elements of the apparatus and related methods of use disclosed herein or to delineate the scope thereof. Upon study of this disclosure and the exemplary implementations herein, one of ordinary skill in the art may readily recognize that various changes, modifications and variations may be made thereto without departing from the spirit and scope of the inventions as defined in the following claims.

The invention claimed is:

1. An apparatus for construction of a stringer, comprising:

a corrugate sheet (30) die cut to form a stringer shape sheet (32), the stringer shape sheet (32) comprising a plurality of parallel stringer sections (33), each stringer section (33) defined by die cuts extending from an upper surface through a lower surface of the stringer shape sheet (32), the die cuts define a peripheral shape of each stringer section (33) and define shear bridges (34) intermittently spaced along the die cuts with each shear bridge (34) formed by an uncut section along the die cuts through the corrugate sheet (30), the shear bridges connect adjacent stringer sections (33) to retain the stringer sections (33) on the stringer shape sheet (32), and whereby the shear bridges (34) are configured to tear under application of force to separate the parallel stringer sections (33) from the stringer shape sheet (32).

2. The apparatus of claim 1, further comprising:

an adhesive coating upon at least one of an upper surface and a lower surface of the stringer shape sheet (32).

3. The apparatus of claim 1, wherein the corrugate sheet (30) comprises corrugated fiberboard.

4. The apparatus of claim 1, wherein the corrugate sheet (30) comprises corrugated plastic.

5. The apparatus of claim 1, further comprising:

a plurality of stringer shaped sheets (32) laminated together to form a plurality of stringers (12) interconnected by the shear bridges (34).

6. An apparatus for construction of a stringer, comprising:

corrugate sheet die cut to form a stringer shape sheet, the stringer shaped sheet (32) comprising a plurality of stringer sections (33) parallel to one another, each stringer section (33) defined by die cuts extending from an upper surface through a lower surface of the stringer shape sheet (32), the die cuts define a peripheral shape of each stringer section (33) and define shear bridges (34) intermittently spaced along the die cuts with each shear bridge (34) formed by an uncut section along the die cuts through the corrugate sheet (30), the shear bridges connect adjacent stringer sections (33) to retain the stringer sections (33) on the stringer shape sheet (32), and whereby the shear bridges (34) are configured to tear under application of force to separate the stringer sections (33) from the stringer shape sheet (32).

7. The apparatus of claim 6, further comprising:

an adhesive coating upon at least one of an upper surface and a lower surface of the stringer shape sheet (32).

8. The apparatus of claim 6, further comprising:

a plurality of stringer shaped sheets (32) laminated together to form a plurality of stringers (12) interconnected by the shear bridges (34).

9. The apparatus of claim 6, wherein the corrugate sheet (30) comprises corrugated fiberboard.

10. The apparatus of claim 6, wherein the corrugate sheet (30) comprises corrugated plastic.

* * * * *